US005078209A

United States Patent [19]

Kerkman et al.

[11] Patent Number: 5,078,209

[45] Date of Patent: Jan. 7, 1992

[54] HEAT EXCHANGER ASSEMBLY

[75] Inventors: William J. Kerkman; Charles E. Goodremote; Richard M. DeKeuster, all of Racine, Wis.

[73] Assignee: Modine Manufacturing Co., Racine, Wis.

[21] Appl. No.: 651,548

[22] Filed: Feb. 6, 1991

[51] Int. Cl.[5] ..... F28F 3/08

[52] U.S. Cl. ..... 165/167; 165/916

[58] Field of Search ..... 165/119, 51, 167, 916

[56] References Cited

U.S. PATENT DOCUMENTS

| | | |
|---|---|---|
| 1,736,906 | 7/1927 | Flintermann . |
| 2,222,721 | 4/1936 | Ramsaur et al. . |
| 2,360,123 | 9/1942 | Gerstung et al. . |
| 2,511,084 | 11/1947 | Shaw . |
| 2,702,021 | 11/1972 | Wolfe et al. . |
| 3,743,011 | 7/1973 | Frost . |
| 3,795,274 | 3/1974 | Fieni . |
| 4,258,785 | 3/1981 | Beldam . |
| 4,360,055 | 11/1982 | Frost . |
| 4,561,494 | 11/1985 | Frost . |
| 4,580,625 | 4/1986 | Yamanaka et al. . |
| 4,638,856 | 1/1987 | Yamanaka et al. . |
| 4,669,532 | 6/1987 | Tejima et al. . |
| 4,696,339 | 9/1987 | Schwarz . |
| 4,708,199 | 11/1987 | Yogo et al. . |
| 4,892,136 | 1/1990 | Ichihara et al. . |

FOREIGN PATENT DOCUMENTS

| | | |
|---|---|---|
| 0208957 | 1/1987 | European Pat. Off. . |
| 3222278A | 6/1982 | Fed. Rep. of Germany . |
| 2010517 | 2/1970 | France . |
| 2494418 | 5/1982 | France ..... 165/916 |

*Primary Examiner*—John Ford

*Attorney, Agent, or Firm*—Wood, Phillips, Mason, Rectenwald & VanSanten

[57] ABSTRACT

In order to eliminate components and fixtures, facilitate assembly, avoid leaks, and reduce cost in a heat exchanger for exchanging heat between two fluids such as a coolant and oil, the heat exchanger includes a header plate having a central opening defined by a column integrally formed with the header plate together with a radial opening. A plurality of heat exchange units are stacked on the header plate. The heat exchange units each comprise a pair of plates joined together at inner and outer peripheral edges to thereby sealingly define a plurality of first chambers for the flow of one of the fluids wherein a column-receiving opening is provided radially inwardly of the first chambers thereof. The heat exchange units further include aligned first openings and aligned second openings on opposite sides of the column-receiving openings for joining the first chambers in a first fluid flow path, and the radial opening in the header plate comprises a first fluid inlet for directing the first fluid through one of the first openings into the first fluid flow path where it flows until it reaches a first fluid outlet therefor. The heat exchange units are stacked on the header plate about the column where they are arranged in a spaced series by spacers which serve to define a plurality of second chambers for the flow of the second fluid between each pair of the spaced series of heat exchange units.

17 Claims, 3 Drawing Sheets

HEAT EXCHANGER ASSEMBLY

FIELD OF THE INVENTION

This invention generally relates to a heat exchanger assembly and, more particularly, a heat exchanger assembly having an extruded header plate and central column.

BACKGROUND OF THE INVENTION

Prior art of possible relevance includes U.S. Pat. Nos. 3,743,011 issued July 3, 1973; 4,360,055 issued Nov. 23, 1982; and 4,561,494 issued Dec. 31, 1985, all to Frost.

Heat exchangers made according to any of the above-identified patents have proved to be extremely successful in commercial applications. This is particularly true of applications such as cooling the lubricating oil in an internal combustion engine In this connection, the disclosed structures are relatively simple in design, inexpensive to fabricate, and readily serviceable when required.

Nonetheless, it is desirable to provide additional advantages in a heat exchanger assembly including, for example, a reduction in the number of components, an elimination of the need for fixtures, a reduction in the number of joints subject to possible leakage, an enhancement in ease of fabrication, and a reduction in expense.

As will be appreciated, the present invention differs from those set forth in the above identified patents in providing these and other advantages which are disclosed and claimed herein.

SUMMARY OF THE INVENTION

It is a principal object of the present invention to provide a new and improved heat exchanger and, more specifically, to provide a new and improved heat exchanger of the type utilizing a plurality of heat exchange units in stacked relation on an integrally extruded header plate and column, and wherein the components are more easily assembled in a leak-proof manner while reducing the overall cost.

Accordingly, an exemplary embodiment of the present invention achieves the foregoing objects in a heat exchanger assembly for exchanging heat between first and second fluids by utilizing a header plate which has a central opening defined by a column integrally formed with the header plate together with a radial opening therein. A plurality of heat exchange units are stacked on the header plate. The heat exchange units each comprise a pair of plates joined together at its inner and outer peripheral edges to thereby sealingly define a first chamber for the flow of the first fluid wherein a column-receiving opening is provided radially inwardly of the first chambers thereof. The heat exchange units further include aligned first openings and aligned second openings on opposite sides of the column-receiving openings for joining the first chambers in a first fluid flow path, and the radial opening in the header plate comprises a first fluid inlet for directing the first fluid through one of the first openings into the first fluid flow path where it flows until it reaches a first fluid outlet therefor. The heat exchange units are stacked on the header plate about the column where they are arranged in a spaced series by spacer means which serve to define a plurality of second chambers for the flow of the second fluid between each pair of the spaced series of heat exchange units A tank covers the heat exchange units stacked on the header plate. With this arrangement, the tank is integrally secured to the header plate and to the column to sealingly confine the second chambers, and it has an inlet for directing the second fluid into the second chambers and an outlet for receiving the second fluid from the second chambers after it has flowed through a second fluid flow path.

In a highly preferred embodiment, the header plate and central column are integrally formed of impact extruded aluminum. In one form of the invention, a stand-off is also integrally formed with the header plate on the side thereof opposite the column in order to space the heat exchange units, for instance, from an engine block or the like. In either case, an O-ring receiving recess may be integrally formed during extrusion to form a seal on the engine block.

Advantageously, the heat exchange units and the column have cooperative alignment means for ensuring alignment of respective ones of the first and second openings. The alignment means preferably comprises a tab and recess arrangement wherein a pair of integrally extruded axially extending tabs or ears is formed on the column and a pair of corresponding tab-receiving recesses is formed on each of the plates. With this arrangement, the heat exchange units may be rapidly stacked on the header plate about the central column in proper alignment to thereby facilitate assembly.

In a most highly preferred embodiment, the spacer means comprises a plurality of buttons on the plates. Preferably, the buttons are stamped in the plates and thus are integral therewith. The buttons are arranged in a common pattern on surfaces of the plates facing away from the first chambers of the heat exchange units such that the buttons automatically arrange the heat exchange units in a spaced series to define the second chambers. As a result, the buttons allow the flow of fluid between each pair of the spaced series of heat exchange units.

For some applications, the heat exchange units have turbulator means within the first chambers which may comprise a separate component disposed between the plates of each of the heat exchange units. However, and most advantageously, the turbulator means may be formed by a plurality of parallel indentations in a ripple pattern on the surface of each plate facing toward the first chambers thereof.

Other objects, advantages and features of the present invention will become apparent from a consideration of the following specification taken in conjunction with the accompanying drawings.

DETAILED DESCRIPTION OF THE PREFERRED EMBODIMENTS

Figure 1:
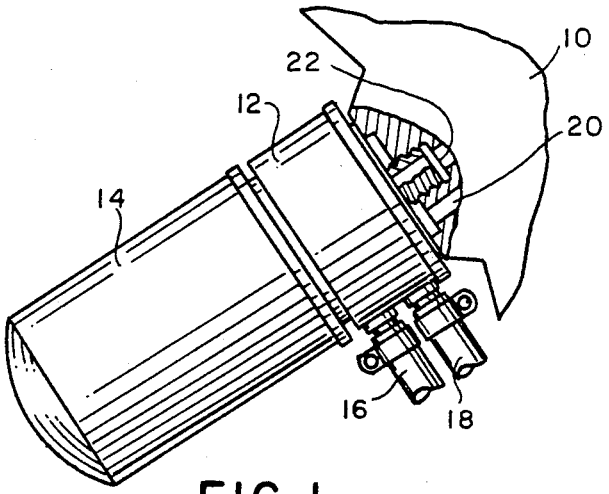
FIG. 1 is a view of a heat exchanger made according to the present invention and employed as an oil cooler mounted on the block of an engine in connection with an oil filter.

An exemplary embodiment of a heat exchanger made according to the invention is illustrated in FIG. 1 in the environment of an internal combustion engine having an engine block 10. A heat exchanger 12 connected to an oil filter 14 serves as an oil cooler for a first fluid such as a lubricating oil for the engine The heat exchanger 12 includes inlet and outlet lines 16 and 18, respectively, for a second fluid which may be, e.g., an engine coolant or the like. As will be appreciated, lubricating oil is directed to the heat exchanger 12 via a passage 20 in the engine block 10 while return lubricating oil is received by the engine via a passage 22.

Figure 2:
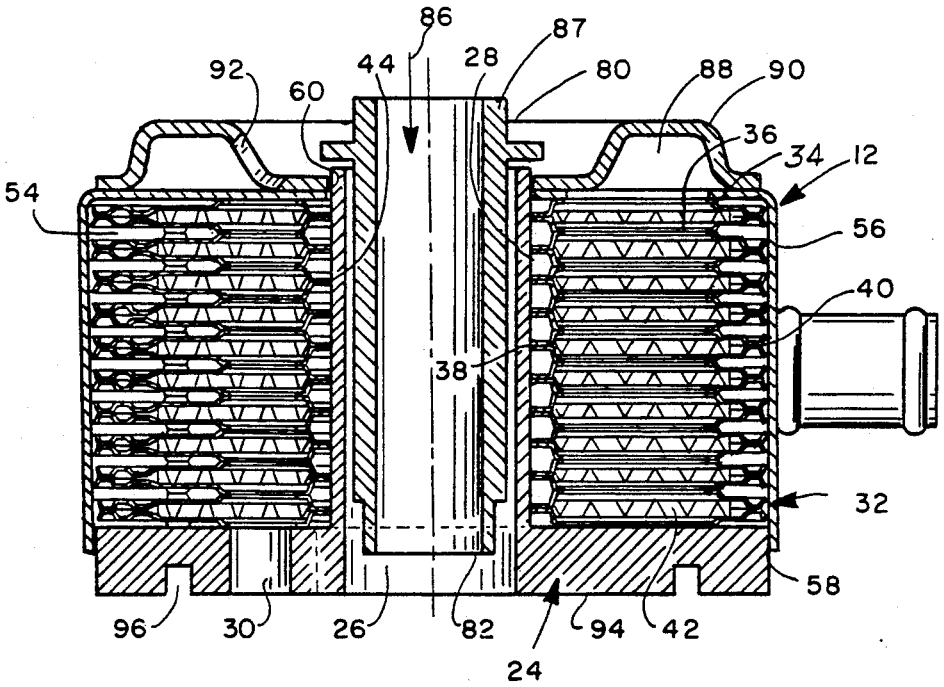
FIG. 2 is an enlarged, horizontal sectional view illustrating various details of a heat exchanger made according to the present invention.
Figure 3:
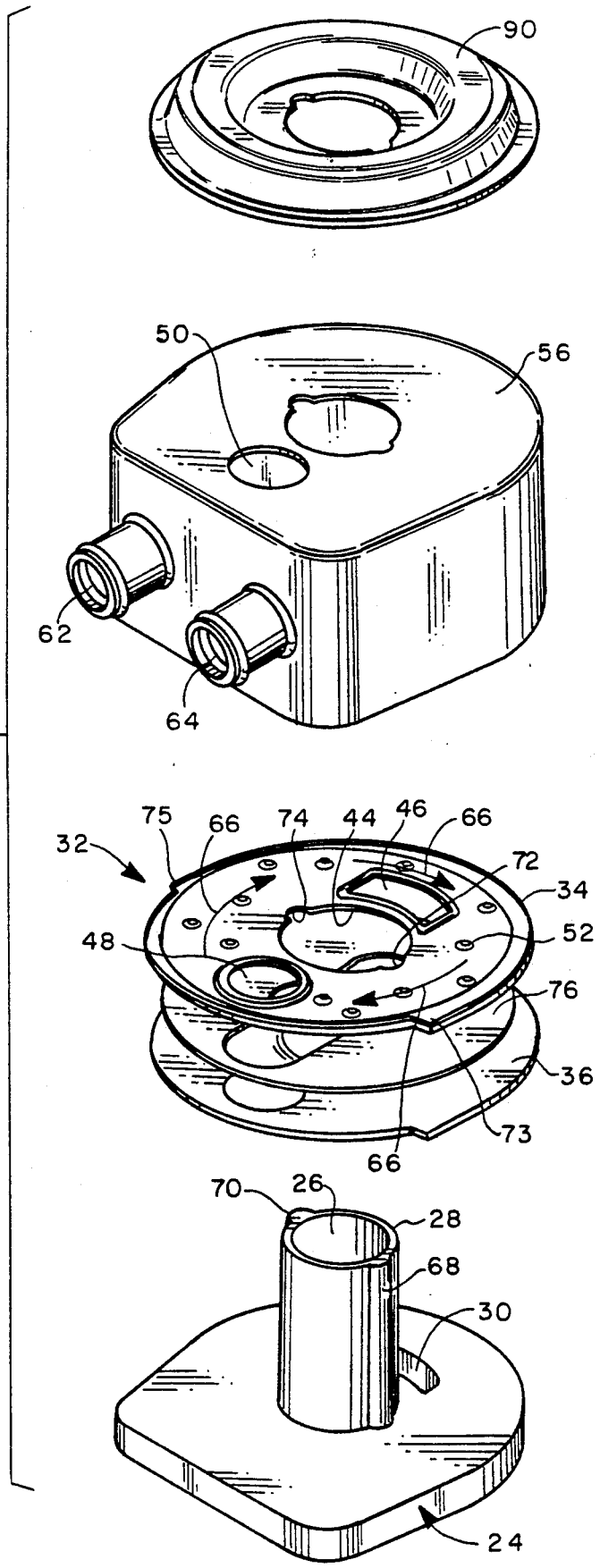
FIG. 3 is an exploded perspective view illustrating the components of one of a plurality of heat exchange units to be stacked on a header plate.

As shown in FIGS. 2 and 3, the heat exchanger 12 includes a header plate 24 which is provided with a central opening 26 defined by a column 28 integrally formed in one piece with the header plate 24, and the header plate 24 also has a radial opening 30. A plurality of heat exchange units 32 are stacked on the header plate 24. The heat exchange units 32 each comprise a pair of identical plates 34 and 36 joined together at inner and outer peripheral edges 38 and 40 to thereby sealingly define a plurality of first chambers 42 for the flow of the lubricating oil wherein a column-receiving opening 44 is formed radially inwardly of the first chambers 42 thereof. The heat exchange units 32 further include aligned first openings 46, and aligned second openings 48 on opposite sides of the column-receiving openings 44 for joining the first chambers 42 in a first fluid flow path, and the radial opening 30 in the header plate 24 comprises a first fluid inlet for directing the lubricating oil through one of the first openings 46 into the first fluid flow path where it flows until it reaches a first fluid outlet 50 therefor. The heat exchange units 32 are stacked on the header plate 24 about the column 28 where they are arranged in a spaced series by spacer means in the form of buttons 52 stamped in the plates 34, 36 which serve to define a plurality of second chambers 54 for the flow of the coolant between each pair of the spaced series of heat exchange units 32. With this arrangement, a tank 56 containing the first fluid outlet 50 covers the heat exchange units 32 stacked on the header plate 24 and, as best shown in FIG. 2, the tank 56 is integrally secured to the header plate 24 as at 58 and to the column 28 as at 60.

More specifically, the tank 56 is advantageously secured in a manner such as brazing so as to sealingly confine the coolant or cooling liquid within the tank 56 as it flows through the second chambers 54. It will be seen that the tank 56 has an inlet 62 for directing the coolant into the second chambers 54 and an outlet 64 for receiving the coolant from the second chambers 54. As best shown in FIG. 3, the coolant flows through the second chambers 54 in a second fluid flow path which is generally represented by the arrows 66, i.e., substantially entirely about the plates such as 34 and 36.

As will be appreciated, the heat exchange units may be sealingly formed at the time of brazing the tank 56 to the header plate 24 and the column 28. This may all be done at one time by appropriately assembling all of the components before placing the heat exchanger in a brazing oven. As a result, the manufacture of the heat exchanger is greatly simplified which leads to still further cost savings.

In the illustrated embodiment, the header plate 24 and column 28 may be advantageously integrally formed by impact extruding aluminum. It will also be seen that the heat exchange units 32 and the column 28 have cooperative alignment means, preferably in the form of a tab and recess arrangement wherein the column 28 includes a pair of integrally extruded axially extending tabs or ears 68 and 70 and the plates, such as 34, have a pair of corresponding tab-receiving recesses 72 and 74, respectively, which serve to ensure proper alignment when the heat exchange units are stacked on the header plates. More specifically, the tabs 68 and 70 and tab-receiving recesses 72 and 74 thereby serve to ensure alignment of the respective ones of the first and second openings 46 and 48.

In addition, the plates such as 34 may have ears 73 and 75 formed on the outer peripheral edges thereof. The header plate 24 as well as the tank 56 may then be formed so as to have a non-circular cross-section so as to generally conform to the shape of the plates having the ears thereon. As a result, the alignment of all of these components for assembly is thereby facilitated to further reduce cost.

Figure 4:
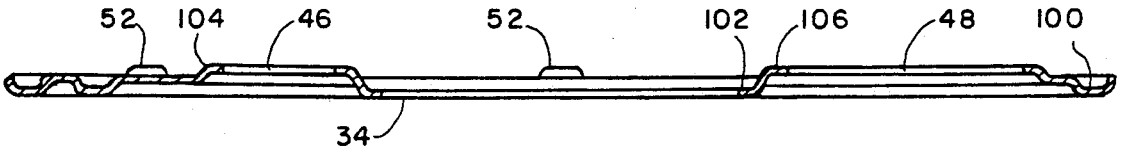
FIG. 4 is an enlarged, horizontal, sectional view of one plate embodiment for a heat exchange unit of a heat exchanger made according to the present invention.

As best shown in FIGS. 2 and 4, the buttons 52 are arranged in a common pattern on surfaces of the plates 34 and 36 facing away from the first chambers 42 of the heat exchange units 32. With this arrangement, the buttons 52 arrange the heat exchange units 32 in a spaced series. As a result, the buttons 52 define a plurality of second chambers 54 for the flow of the coolant between each pair of the spaced series of heat exchange units 32.

In the embodiment illustrated in FIG. 3, the heat exchange units 32 have a separate turbulator 76 which is disposed within the first chambers 42 of each of the heat exchange units. It will be appreciated by referring to FIGS. 5 and 6, however, that the heat exchange units 32 may each include an integrally formed turbulator. More specifically, the turbulator may be formed by a plurality of parallel indentations 78 in a ripple pattern on surfaces of the plates 34 and 36 facing toward the first chambers 42 thereof.

Figure 5:
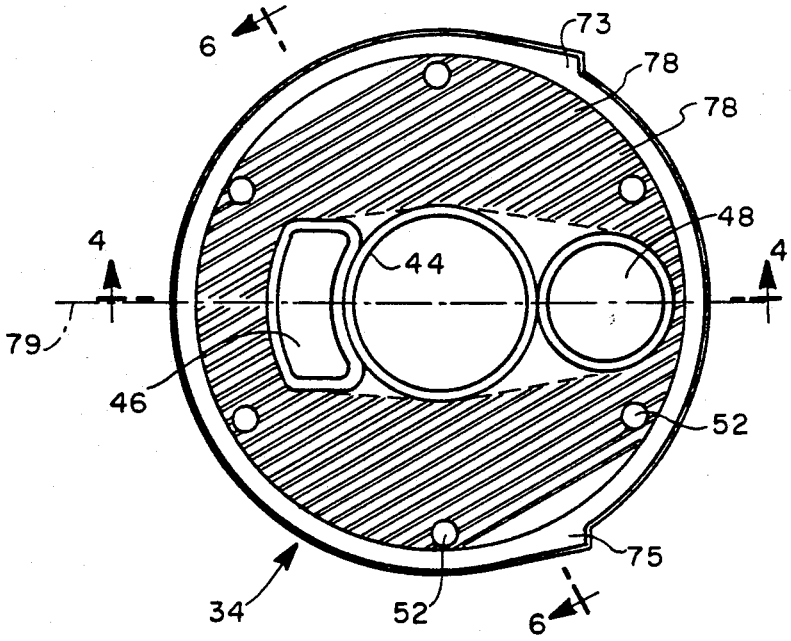
FIG. 5 is a plan view illustrating another plate embodiment for a heat exchange unit of a heat exchanger made according to the present invention.
Figure 6:
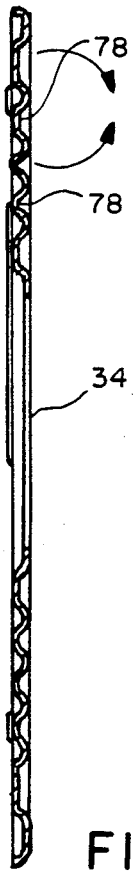
FIG. 6 is an enlarged, horizontal, sectional view of the plate embodiment illustrated in FIG. 5 illustrating details of the ripple pattern thereof.

As should now be apparent, the plates 34 and 36 making up any one of the heat exchange units 32 are identical in every respect which also serves to reduce the cost of manufacture and assembly rather significantly. It will be appreciated, however, that the plates, such as 34 and 36, of each one of the heat exchange units 32 are inverted relative to one another to thereby be disposed with the respective buttons 52 facing outwardly of the first chamber 42 thereof. Also, by forming the parallel indentations 78 at an angle to the axis 79 as shown in FIG. 5, the respective indentations 78 of the plates 34 and 36 making up any one of the heat exchange units 32 are at twice that angle to form the turbulator. Referring once again to FIG. 2, the column 28 will be seen to be hollow to receive a suitable conduit or rigid tube 80 therewithin. It will be appreciated that the conduit or tube 80 has one end 82 adapted to be connected to the engine block 10 or a fitting therein, and it has an opposite end 87 to which the filter 14 (see FIG.

1) may be mounted. As will be appreciated, the conduit or tube 80 serves as a return path as indicated by the arrow 86 for lubricating oil which is leaving the filter 14.

When the heat exchanger 12 is utilized with a coolant and lubricating oil, the radial opening 30 in the header plate 24 comprises a lubricating oil inlet and the radial opening 50 in the tank 56 comprises a lubricating oil outlet. A lubricating oil may thereby pass through the passage 20 in the engine block 10, and then through the heat exchanger 12 by means of the respective aligned first and second openings 46 and 48 in the heat exchange units 32. Finally, the lubricating oil will pass from the heat exchanger 12 through the lubricating oil outlet 56 into the space 88 between the tank 56 and the dome 90 which will have an outlet 92 through which the lubricating oil may be directed into the filter 14.

As will also be appreciated, the first chambers 42 comprise lubricating oil chambers and the second chambers 54 comprise coolant, i.e., cooling liquid, chambers and the second inlet 16 and second outlet 18 comprise, respectively, a coolant or cooling liquid inlet and outlet.

Figure 7:
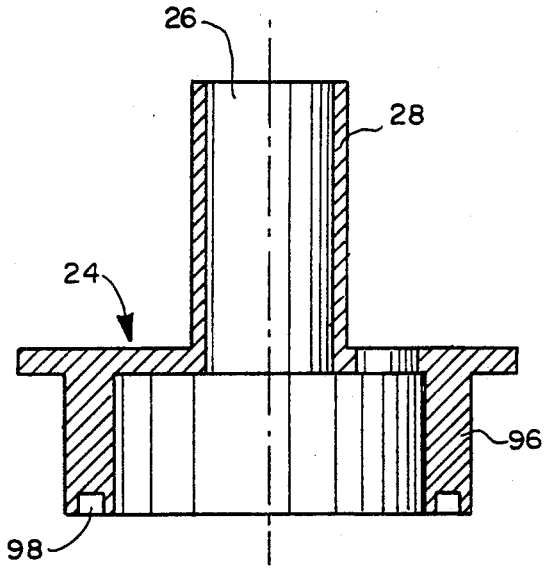
FIG. 7 is a vertical, sectional view of another header plate embodiment having a stand-off for a heat exchanger made according to the present invention.

By comparing FIGS. 2 and 7, another aspect of the present invention will be appreciated. It will be seen that the header plate 24 may either comprise a substantially flat surface 94 on the bottom thereof or, alternatively, (see FIG. 7) the header plate 24 may include a stand-off 96 which is advantageously integrally formed by impact extrusion with the header plate 24 on the side thereof opposite the column 28. In either case, the flat surface 94 or the stand-off 96 includes means for creating a seal against the engine block.

More specifically, the flat surface 94 and the stand-off 96 each include an O-ring receiving recess 96 and 98, respectively. The O-ring receiving recesses 96 and 98 are advantageously integrally formed during the impact extrusion process on the side of the header plate 24 opposite the column 28. In this manner, the header plate 24 may be sealed against the engine block 10 about the lubricating oil passage 20 provided therein.

As will be appreciated, the stand-off 96 may be utilized where it is desired to isolate the heat exchanger 12 from the heat present in the engine block 10.

Referring to FIGS. 3 and 4, it will be understood how it is possible to ensure the seals that are required for the chambers 42. As shown, each of the plates 34 and 36 have a generally circumferential continuous embossment 100 about the outer periphery thereof, a generally circumferential continuous embossment 102 about the column-receiving opening 44 thereof, and oppositely directed generally circumferential continuous embossments 104 and 106 about the respective openings 46 and 48 thereof When assembled, the embossments 100, 102, 104 and 106 of plates 34 and 36 are nominally in contact with each other.

By reason of this fact, the plates 34 and 36 defining each of the chambers 42 may be subjected to brazing temperatures which will cause the embossments to braze together to form a leak-tight construction. This is ensured, assuming the individual units comprised of a pair of plates 34 and 36 are not prefabricated before being applied to the column 28, by pushing the complete set of plates 34 and 36 as deeply as possible onto the header plate 24 where they may be held by an appropriate friction-fit lock ring (not shown). Thus, it is possible to compress the entire stack of plates 34 and 36 so as to hold them with the respective embossments in contact for leak-tight brazing.

As will be appreciated, this compression could alternatively be accomplished by utilizing a suitable jig. This would allow prefabrication, if desired, but in any event the embossments 100, 102, 104 and 106 serve as means for establishing a seal around the outer periphery of the individual plates 34 and 36 forming a heat exchange unit 32, about the inner periphery, i.e., the column-receiving openings 44, of the plates 34 and 36, and about the radial openings 46 and 48 in adjacent ones of the heat exchange units 32 to thereby facilitate communication of the first chamber 42 of one of the heat exchange units 32 with the first chamber 42 of the next adjacent of the heat exchange units 32. Of course, the tabs or ears 68 and 70, the recesses 72 and 74, and the ears 73 and 75 all assist by ensuring alignment prior to brazing.

From the foregoing, it will be appreciated that the present invention accomplishes a number of important objectives among which are the fact that the total number of components has been significantly reduced to thereby facilitate assembly while reducing cost. This also serves to eliminate a number of potential leak joints In addition, the present invention eliminates the need for assembly and brazing fixtures as well as the need for a separate turbulator while also making it possible to incorporate an integral stand-off for further enhancing heat transfer characteristics.

While in the foregoing there have been set forth preferred embodiments of the invention, it will be appreciated that the details herein given may be varied by those skilled in the art without departing from the true spirit and scope of the appended claims.

We claim:

1. A heat exchanger for exchanging heat between first and second fluids, comprising:

a header plate having a central opening, said central opening being defined by a column integrally formed in one piece with said header plate, said header plate also having a radial opening;

a plurality of heat, exchange units stacked on said header plate and impaled on said column, said heat exchange units each comprising a pair of plates joined together at inner and outer peripheral edges to thereby sealingly define a plurality of first chambers for the flow of said first fluid and to define a plurality of column receiving openings radially inwardly of said first chambers thereof, and spacer means for maintaining said heat exchange units in spaced relation;

said heat exchange units further including aligned first openings and aligned second openings on opposite sides of said column receiving openings for joining said first chambers in a first fluid flow path;

said radial opening in said header plate comprising a first fluid inlet for directing said first fluid into said first fluid flow path and said heat exchanger further including a first fluid outlet for receiving said first fluid from said first fluid flow path;

said spacer means arranging said heat exchange units in a spaced series to define a plurality of second for the flow of said second fluid between each pair of said spaced series of heat exchange units; and a tank covering said heat exchange units stacked on said header plate, said tank being secured to said header plate and to said column in such manner as to sealingly confine said second chambers, said tank having an inlet for directing said second fluid into said second chambers and an outlet for receiving said second fluid from said second chambers, said second fluid flowing through said second chambers in a second fluid flow path.

2. The heat exchanger of claim 1 wherein said header plate and column are integrally extruded from aluminua.

3. The heat exchanger of claim 1 wherein said spacer means comprises buttons arranged in a pattern on said plates.

4. The heat exchanger of claim 1 wherein said heat exchange units and said column have cooperative alignment means.

5. The heat exchanger of claim 1 wherein said heat exchange units have turbulator means within said first chambers.

6. The heat exchanger of claim 1 includes a stand-off integrally formed with said header plate opposite said column.

7. A heat exchanger for exchanging heat between a first fluid comprising a lubricating oil and a second fluid comprising a cooling liquid for said lubricating oil, comprising:

an extruded header plate having a central opening, said central opening being defined by a column integrally extruded in one piece with said header plate, said header plate also having a radial opening;

a plurality of heat exchange units stacked on said header plate and impaled on said column, said heat exchange units each comprising a pair of plates together at inner and outer peripheral edges to thereby sealingly define a plurality of first chambers for the flow of said lubricating oil and to define a plurality of column receiving openings radially inwardly of said first chambers thereof, and spacer means for maintaining said heat exchange units in spaced relation;

said spacer means comprising a plurality of buttons arranged in a pattern on surfaces of said plates facing away from said first chambers of said heat exchange units;

said heat exchange units further including aligned first openings and aligned second openings on opposite sides of said column receiving openings for joining said first chambers in a lubricating oil flow path;

said heat exchange units and said column having cooperative alignment means for ensuring alignment of respective ones of said first and second openings when said heat exchange units are stacked on said header plate;

said radial opening in said header plate comprising a lubricating oil inlet for directing said lubricating oil into said lubricating oil flow path and said heat exchanger further including a lubricating oil outlet for receiving said lubricating oil from said lubricating oil flow path;

said buttons arranging said heat exchange units in a spaced series to define a plurality of second chambers for the flow of said cooling liquid between each pair of said spaced series of heat exchange units; and a tank covering said heat exchange units stacked on said header plate, said tank being secured to said header plate and to said column in such manner as to sealingly confine said second chambers, said tank having an inlet for directing said cooling liquid into said second chambers and an outlet for receiving said cooling liquid from said second chambers, said cooling liquid flowing through said second chambers in a cooling liquid flow path.

8. The heat exchanger of claim 7 wherein said header plate and column are impact extruded from aluminum.

9. The heat exchanger of claim 7 wherein said alignment means comprises a tab and recess arrangement.

10. The heat exchanger of claim 9 wherein said column includes a pair of integrally extruded axially extending tabs.

11. The heat exchanger of claim 10 wherein said plates each have a pair of corresponding tab receiving recesses.

12. The heat exchanger of claim 7 wherein said heat exchange units have turbulator means within said first chambers.

13. The heat exchanger of claim 7 includes a stand-off integrally formed with said header plate opposite said column 14. A heat exchanger for exchanging heat between a first fluid comprising a lubricating oil and a second fluid comprising a cooling liquid for said lubricating oil, comprising:

an impact extruded aluminum header plate having a central opening, said central opening being defined by a column integrally extruded in one piece with said header plate, said header plate also having a radial opening;

said column being hollow to receive a conduit having one end adapted to be connected to an engine block and an opposite end to which a filter for said lubricating oil may be mounted;

a plurality of heat exchange units stacked on said header plate and impaled on said column, said heat exchange units each comprising a pair of plates joined together at inner and outer peripheral edges to thereby sealingly define a plurality of first chambers for the flow of said lubricating oil and to define a plurality of column receiving openings radially inwardly of said first chambers thereof, and spacer means for maintaining said heat exchange units in spaced relation;

said spacer means comprising a plurality of buttons arranged in a common pattern on surfaces of said plates facing away from said first chambers of said heat exchange units; said heat exchange units each including a turbulator formed by a plurality of parallel indentations formed in a ripple pattern on surfaces of said plates facing toward said first chambers thereof;

said heat exchange units further including aligned first openings and aligned second openings on opposite sides of said column receiving openings for joining said first chambers in a lubricating oil flow path;

said heat exchange units and said column having cooperative alignment means including a tab and recess arrangement for ensuring alignment of respective ones of said first and second openings when said heat exchange units are stacked on said header plate;

said radial opening in said header plate comprising a lubricating oil inlet for directing said lubricating oil into said lubricating oil flow path and said heat exchanger further including a lubricating oil outlet for receiving said lubricating oil from said lubricating oil flow path;

said buttons arranging said heat exchange units in a spaced series to define a plurality of second chambers for the flow of said cooling liquid between each pair of said spaced series of heat exchange units; and a tank covering said heat exchange units stacked on said header plate, said tank being secured to said header plate and to said column in such manner as to sealingly confine said second chambers, said tank having an inlet for directing said cooling liquid into said second chambers and an outlet for receiving said cooling liquid from said second chambers, said cooling liquid flowing through said second chambers in a cooling liquid flow path.

15. The heat exchanger of claim 14 wherein said column includes a pair of integrally extruded axially extending tabs and said plates each have a pair of tab receiving recessed.

16. The heat exchanger of claim 14 wherein said header plate has an O-ring receiving recess integrally formed during extrusion on the side opposite said column.

17. The heat exchanger of claim 14 includes a standoff having an O-ring receiving recess integrally formed with said header plate on the side opposite said column.

* * * * *